US008362865B2

(12) United States Patent
Banno

(10) Patent No.: US 8,362,865 B2
(45) Date of Patent: Jan. 29, 2013

(54) ELECTRONIC COMPONENT

(75) Inventor: Yoshiko Banno, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/168,692

(22) Filed: Jun. 24, 2011

(65) Prior Publication Data

US 2011/0254650 A1 Oct. 20, 2011

Related U.S. Application Data

(63) Continuation of application No. PCT/JP2010/050098, filed on Jan. 7, 2010.

(30) Foreign Application Priority Data

Jan. 8, 2009 (JP) ..... 2009-002159

(51) Int. Cl.
*H01F 5/00* (2006.01)
*H01F 27/02* (2006.01)
*H01F 27/28* (2006.01)

(52) U.S. Cl. ..... 336/200; 336/83; 336/223

(58) Field of Classification Search ..... 336/200, 336/222, 223, 232, 83
See application file for complete search history.

(56) References Cited

U.S. PATENT DOCUMENTS

| | | | | |
|---|---|---|---|---|
| 5,250,923 | A * | 10/1993 | Ushiro et al. | 336/83 |
| 6,114,936 | A * | 9/2000 | Yamamoto et al. | 336/192 |
| 6,498,555 | B1 * | 12/2002 | Sakata | 336/200 |
| 7,164,339 | B2 * | 1/2007 | Huang | 336/200 |
| 7,495,525 | B2 * | 2/2009 | Ilkov et al. | 333/26 |
| 2001/0017582 | A1 * | 8/2001 | Sakata | 336/200 |
| 2006/0284718 | A1 * | 12/2006 | Baumgartner et al. | 336/223 |

FOREIGN PATENT DOCUMENTS

| | | | |
|---|---|---|---|
| JP | 10-321436 | A | 12/1998 |
| JP | 10-335143 | A | 12/1998 |
| JP | 2002-015925 | A | 1/2002 |
| JP | 2003-283204 | A | 10/2003 |
| JP | 2003-332131 | A | 11/2003 |
| JP | 2006-066829 | A | 3/2006 |
| JP | 2008-130970 | A | 6/2008 |
| WO | 2008/018203 | A1 | 2/2008 |
| WO | 2010/007858 | A1 | 1/2010 |
| WO | 2010/016345 | A1 | 2/2010 |

OTHER PUBLICATIONS

International Search Report; PCT/JP2010/050098; Apr. 13, 2010.
J.Tanaka; Written Opinion of the International Searching Authority; PCT/JP2010/050098; Apr. 13, 2010.

* cited by examiner

*Primary Examiner* — Mohamad Musleh
*Assistant Examiner* — Mangtin Lian
(74) *Attorney, Agent, or Firm* — Studebaker & Brackett PC; Tim L. Brackett, Jr.; John F. Guay

(57) ABSTRACT

In an electronic component having a built-in coil composed of coil conductors with a length of one turn, the inductance value can be increased while suppressing generation of short circuits inside the coil conductors. The electronic component includes a multilayer body formed by stacking a plurality of magnetic layers on top of one another. The built-in coil includes coil conductors and via hole conductors. The coil conductors each have a ring-shaped coil portion having a cut out portion in one side of one corner thereof, and a connecting portion that form an obtuse angle with a side extending from one end portion of the coil portion and is positioned in a region enclosed or surrounded by the coil portion. Via hole conductors connect the plurality of coil conductors to one another.

6 Claims, 6 Drawing Sheets

ELECTRONIC COMPONENT

CROSS REFERENCE TO RELATED APPLICATIONS

The present application is a continuation of International Application No. PCT/JP2010/050098, filed Jan. 7, 2010, which claims priority to Japanese Patent Application No. 2009-002159 filed Jan. 8, 2009, the entire contents of each of these applications being incorporated herein by reference in their entirety.

TECHNICAL FIELD

The present invention relates to electronic components, and more specifically, to electronic components having built-in coils.

BACKGROUND

A known multilayer electronic component is described in Japanese Unexamined Patent Application Publication No. 2006-66829 (Patent Document 1). FIGS. 8A and 8B are plan views of respective ceramic green sheets 202*a* and 202*b* used in the multilayer electronic component.

In the multilayer electronic component described in Patent Document 1, the ceramic green sheet 202*a* illustrated in FIG. 8A and the ceramic green sheet 202*b* illustrated in FIG. 8B are alternately stacked. The ceramic green sheets 202*a* and 202*b* are respectively provided with coil conductors 204*a* and 204*b*. The coil conductors 204*a* and 204*b* have a length of one turn and have end portions 206*a* and 208*a* and 206*b* and 208*b*. The ceramic green sheets 202*a* and 202*b* are alternately stacked. The end portion 206*a* is connected to the end portion 206*b* of a coil conductor 204*b*, which is provided on the upper side in the stacking direction, through a via hole conductor. The end portion 208*a* is connected to the end portion 208*b* of a coil conductor 204*b*, which is provided on the lower side in the stacking direction, through a via hole conductor. In this way, a coil is formed that is composed of a plurality of coil conductors 204*a* and 204*b*.

There is a problem with the multilayer electronic component described in Patent Document 1 in that it is difficult to obtain a large inductance value. In more detail, in the multilayer electronic component, the coil conductors 204*a* and 204*b* each have a length of one turn. Consequently, in order to connect the coil conductors 204*a* and 204*b* to one another without causing a short circuit, it is necessary to position the end portions 208*a* and 208*b* so as to be inside a rectangular region E1 enclosed by the coil conductors 204*a* and 204*b*.

However, if the end portions 208*a* and 208*b* are positioned inside the region E1, a region E2, which is enclosed by the coil conductors 204*a* and 204*b*, is formed inside the region E1. Lines of magnetic flux cancel each other out in this region E2. Therefore, the region E2 hinders obtaining of a large inductance value in the multilayer electronic component.

Methods of solving this problem, for example, include shifting the end portion 208*b* in the direction of the arrow "a," as shown in FIG. 8B. As a result the area of the region E2 is reduced and consequently the inductance value is increased.

SUMMARY

The present disclosure provides an electronic component having a built-in coil composed of coil conductors with a length of one turn. The structure of the coil conductors can increase the inductance value in the electronic component while suppressing generation of short circuits inside the coil conductors.

In an embodiment of the disclosure, an electronic component includes a multilayer body having a plurality of insulating layers stacked on top of one another. A coil is built into the multilayer body. The coil includes a plurality of coil conductors, each having a ring-shaped coil portion having a cut out portion in one side at one corner thereof, and a connecting portion that connects a first point located in one end portion of the coil portion and a second point located in a direction that forms an obtuse angle with a side of the coil portion extending from the first point and in a region enclosed by the coil portion when seen from the first point. The coil conductors each have a length of one turn. The coil also includes a plurality of via hole conductors that connect the plurality of coil conductors to one another.

In a more specific embodiment, a center line of the connecting portion passes through a region that is inside a rectangle. The rectangle includes sides parallel to sides of the ring-shaped coil portion, and a straight line connects the first point and the second point as a diagonal of the rectangle.

In another more specific embodiment, the center line of the connecting portion connects the first point and the second point and is a straight line.

In yet another more specific embodiment, each ring-shaped coil portion is wire-like and rectangular-shaped.

In another more specific embodiment, the via hole conductors are composed of first via hole conductors that connect other end portions of the coil portions that are adjacent to each other in the stacking direction to one another, and second via hole conductors that connect the connecting portions that are adjacent to one another in the stacking direction to one another.

DETAILED DESCRIPTION

Figure 8A:
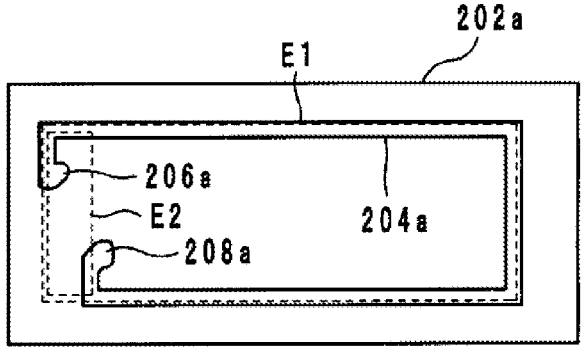
FIG.8A Prior Art
FIGS. 8A and 8B are plan views of ceramic green sheets used in the multilayer electronic component described in Patent Document 1.
Figure 8B:
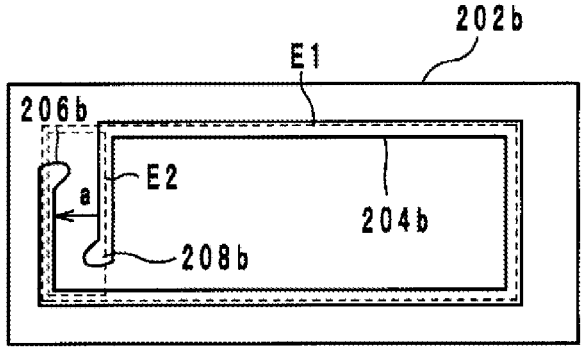
FIG.8B Prior Art

The inventor realized that while shifting an end portion of a coil, such as shifting the end portion 208*b* of coil 204*b* in FIG. 8B in the direction of the arrow a, can help retain a higher inductance value, there is a risk of a short circuit occurring in the coil conductor 204*b*. In more detail, when a portion of the coil conductor 204*b* in the vicinity of the end portion 208*b* is brought close to a portion of the coil conductor 204*b* in the vicinity of the end portion 206*b*, these portions extend parallel to each other. Consequently, if bleeding occurs at the time of screen printing the coil conductor 204*b*, there is a risk of a short circuit occurring between the portion of the coil conductor 204*b* in the vicinity of the end portion 208*b* and the portion of the coil conductor 204*b* in the vicinity of the end portion 206*b*. Therefore, it is difficult to shift the end portion 208*b* by a large amount in the direction of the arrow a.

Figure 1:
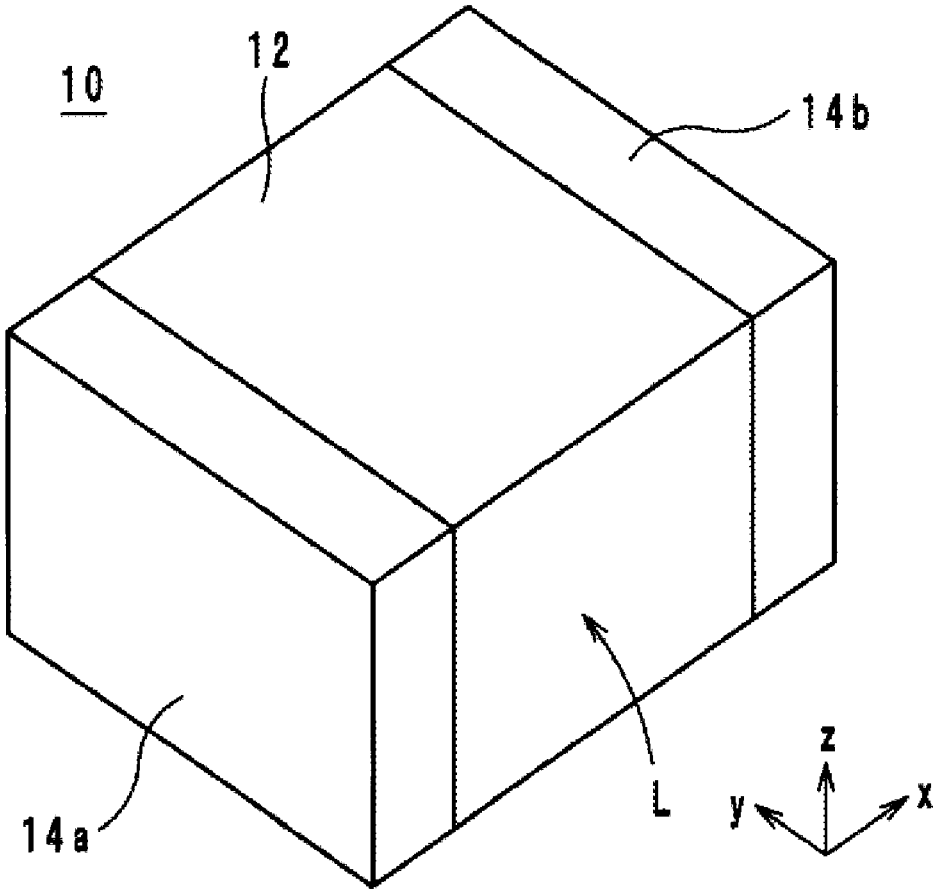
FIG. 1 is an external perspective view of an electronic component according to an exemplary embodiment.
Figure 2:
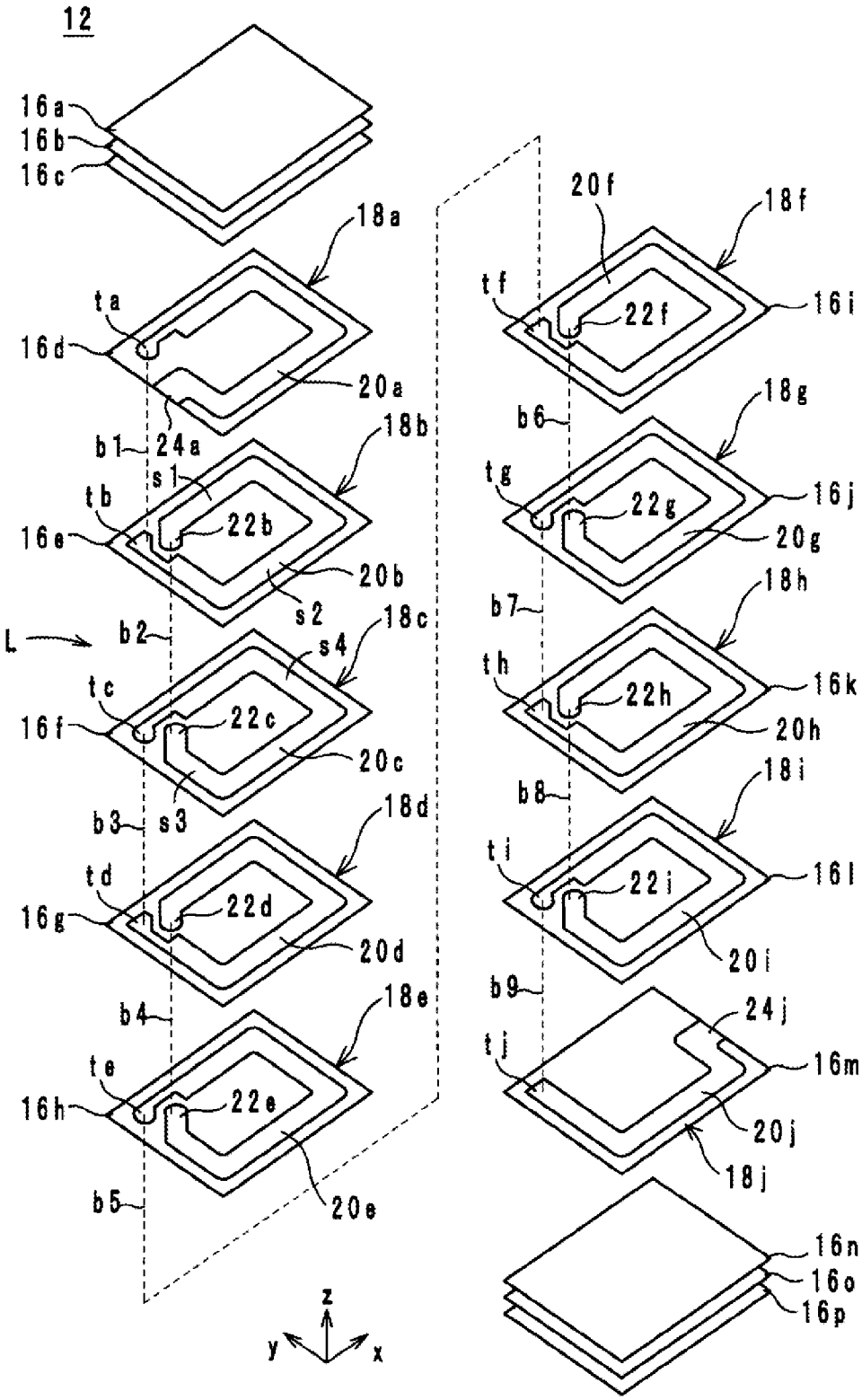
FIG. 2 is an exploded perspective view of a multilayer body of the electronic component of FIG. 1.

Hereafter, an electronic component 10 according to an exemplary embodiment of disclosure will be described while referring to the drawings. FIG. 1 is an external perspective view of the electronic component 10 according to the exemplary embodiment. FIG. 2 is an exploded perspective view of a multilayer body 12 of the electronic component 10 according to the exemplary embodiment. Hereafter, the stacking direction of the electronic component 10 is defined as a z-axis direction, a direction in which the long sides of the electronic component 10 extend is defined as an x-axis direction, and a direction in which the short sides of the electronic component 10 extend is defined as a y-axis direction, although the sides of component 10 along the x and y-axes can be sized differently relative to one another. The x axis, the y axis and the z axis are orthogonal to one another.

As illustrated in FIG. 1, the electronic component 10 includes a multilayer body 12, outer electrodes 14*a* and 14*b*, and a coil L (not visible in FIG. 1). The multilayer body 12 has a rectangular parallelepiped shape and has the coil L built thereinto. The outer electrodes 14*a* and 14*b* are provided so as to respectively cover side surfaces located on the negative and positive sides in the x-axis direction.

As illustrated in FIG. 2, the multilayer body 12 is formed by stacking magnetic layers 16*a* to 16*p* on top of one another in this order in the z-axis direction. Hereafter, in cases where the magnetic layers 16 are referred to individually, alphabetical characters will be appended after the reference numbers, whereas in cases where the magnetic layers 16 are collectively referred to, the alphabetical characters will be omitted from after the reference numbers.

The magnetic layers 16 are rectangular insulating layers fabricated from a ferromagnetic ferrite. In this embodiment, the magnetic layers 16 are formed of a Ni-Cu-Zn-based ferrite.

As illustrated in FIG. 2, the coil L is a spiral-shaped coil that advances in the z-axis direction while looping. As illustrated in FIG. 2, the coil L includes coil conductors 18*a* to 18*j* and via hole conductors b1 to b9. Hereafter, in cases where the coil conductors 18 are referred to individually, alphabetical characters will be appended after the reference numbers, whereas in cases where the coil conductors 18 are collectively referred to, the alphabetical characters will be omitted from after the reference numbers.

The coil conductors 18*a* to 18*j* are electrically connected to one another by the via hole conductors b1 to b9 inside the multilayer body 12 and thereby form the coil L. The coil conductors 18*b* to 18*i* include coil portions 20*b* to 20*i* and connecting portions 22*b* to 22*i* and loop through lengths of one turn on the magnetic layers 16*e* to 16*l*, respectively. Hereafter, the coil conductors 18*b* to 18*i* will be described in more detail. Here, the coil conductors 18*b*, 18*d*, 18*f* and 18*h* all have the same structure and the coil conductors 18*c*, 18*e*, 18*g* and 18*i* all have the same structure. Accordingly, hereafter, the coil conductor 18*b* and the coil conductor 18*c* will be described as examples and description of the other coil conductors 18 can be inferred and understood using these corresponding examples.

Figure 3A:
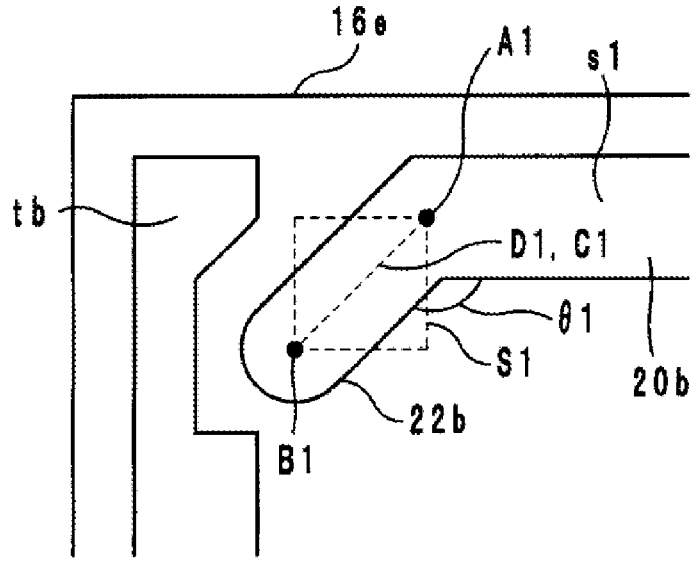
FIG. 3 is an enlarged view of connecting portions shown in FIG. 2.

As illustrated in FIG. 2, the coil portion 20*b* of the coil conductor 18*b* is a rectangular ring-shaped wire-like electrode. Here, the coil portion 20*b* has a structure in which a cut out portion is formed in one of the two sides forming a corner of the rectangular shape. In the coil conductor 18*b* of FIG. 2, the cut out portion is provided by forming one long side s1 to be shorter than another long side s2. The connecting portion 22*b* is a wire-like electrode that is connected to one end portion of the coil portion 20*b* (end portion on the upstream side in the clockwise direction) and extends toward the inside of a rectangular region enclosed (i.e., substantially surrounded) by the coil portion 20*b*. Here, the connecting portion 22*b* will be described in more detail while referring to FIGS. 3A and 3B. FIG. 3A is an enlarged view of the connecting portion 22*b* and FIG. 3B is an enlarged view of the connecting portion 22*c*.

As illustrated in FIG. 3A, the connecting portion 22*b* connects a point A1 and a point B1, which are located at one end portion of the coil portion 20*b*. The point B1 is located in a direction that forms an obtuse angle θ1 with respect to the long side s1 inside a region enclosed by the coil portion 20*b* when seen from the point A1. A center line C1 of the connecting portion 22*b* passes through a region inside a rectangle S1, where a straight line connecting the point A1 and the point B1 is a diagonal D1 of the rectangle S1 and sides of the rectangle S1 are parallel to sides of the wire-like electrode forming the coil portion 20*b*. In this embodiment, as illustrated in FIG. 3A, the center line C1 of the connecting portion 22*b* connects the point A1 and the point B1 with a straight line and is superposed with the diagonal D1.

Next, as illustrated in FIG. 2, the coil portion 20*c* of the coil conductor 18*c* is a rectangular ring-shaped wire-like electrode. Here, the coil portion 20*c* has a structure in which a cut out portion is formed in one of the two sides forming a corner of the rectangular shape. In the coil conductor 18*c* of FIG. 2, the cut out portion is provided by forming one short side s3 to be shorter than another short side s4. The connecting portion 22*c* is a wire-like electrode that is connected to one end portion of the coil portion 20*c* (end portion on the downstream side in the clockwise direction) and extends toward the inside of a rectangular region enclosed by the coil portion 20*c*. Here, the connecting portion 22*c* will be described in more detail while referring to FIG. 3B.

Figure 3B:
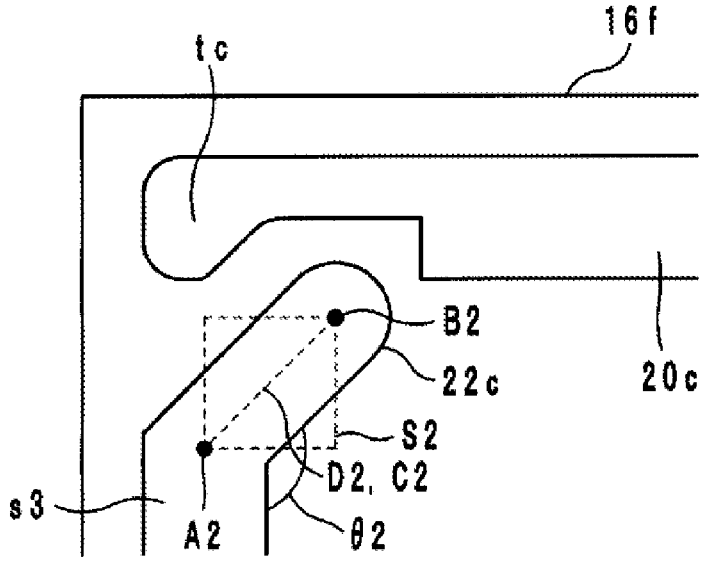

As illustrated in FIG. 3B, the connecting portion 22*c* connects a point A2 and a point B2, which are located at one end portion of the coil portion 20*c*. The point B2 is located in a direction that forms an obtuse angle θ2 with respect to the short side s3 inside a region enclosed by the coil portion 20*c* when seen from the point A2. A center line C2 of the connecting portion 22*c* passes through a region inside a rectangle S2, where a straight line connecting the point A2 and the point B2 is a diagonal D2 of the rectangle S2 and sides of the rectangle S2 are parallel to sides of the wire-like electrode forming the coil portion 20*c*. In this embodiment, as illustrated in FIG. 3B, the center line C2 of the connecting portion 22*c* connects the point A2 and the point B2 with a straight line and is superposed with the diagonal D2.

An end portion tc of the coil portion 20*c* is superposed with an end portion tb of the coil portion 20*b* when viewed in plan from the z-axis direction. Furthermore, the connecting portion 22*c* is superposed with the connecting portion 22*b* when viewed in plan from the z-axis direction.

The coil conductor 18*a* includes a coil portion 20*a* and a drawn out portion 24*a* and is provided on the magnetic layer

16*d* using a conductive material composed of Ag. The coil portion 20*a* loops through a length of ¾ of a turn. The drawn out portion 24*a* is provided at one end portion of the coil portion 20*a* and as illustrated in FIG. 2 is drawn out to a side of the magnetic layer 16*d* on the negative side in the x-axis direction. Furthermore, an end portion ta of the coil portion is superposed with the end portion tb of the coil portion 20*b* when viewed in plan from the z-axis direction.

The coil conductor 18*j* includes a coil portion 20*j* and a drawn out portion 24*j* and is provided on the magnetic layer 16*m* using a conductive material composed of Ag. The coil portion 20*j* loops through a length of ¾ of a turn. The drawn out portion 24*j* is provided at one end portion of the coil portion 20*j* and as illustrated in FIG. 2 is drawn out to a side of the magnetic layer 16*m* on the positive side in the x-axis direction. Furthermore, an end portion tj of the coil portion is superposed with an end portion ti of the coil portion 20*i* when viewed in plan from the z-axis direction.

The via hole conductors b1 to b9 electrically connect the coil conductors 18*a* to 18*j* and thereby form a portion of the spiral-shaped coil L. More specifically, as illustrated in FIG. 2, the via hole conductor b1 penetrates through the magnetic layer 16*d* and thereby connects the end portion ta and the end portion tb, which are adjacent to each other in the z-axis direction. The via hole conductor b2 penetrates through the magnetic layer 16*e* and thereby connects the connecting portion 22*b* and the connecting portion 22*c*, which are adjacent to each other in the z-axis direction. The via hole conductor b3 penetrates through the magnetic layer 16*f* and thereby connects the end portion tc and the end portion td, which are adjacent to each other in the z-axis direction. The via hole conductor b4 penetrates through the magnetic layer 16*g* and thereby connects the connecting portion 22*d* and the connecting portion 22*e*, which are adjacent to each other in the z-axis direction. The via hole conductor b5 penetrates through the magnetic layer 16*h* and thereby connects the end portion to and the end portion tf, which are adjacent to each other in the z-axis direction. The via hole conductor b6 penetrates through the magnetic layer 16*i* and thereby connects the connecting portion 22*f* and the connecting portion 22*g*, which are adjacent to each other in the z-axis direction. The via hole conductor b7 penetrates through the magnetic layer 16*j* and thereby connects the end portion tg and the end portion th, which are adjacent to each other in the z-axis direction. The via hole conductor b8 penetrates through the magnetic layer 16*k* and thereby connects the connecting portion 22*h* and the connecting portion 22*i*, which are adjacent to each other in the z-axis direction. The via hole conductor b9 penetrates through the magnetic layer 16*l* and thereby connects the end portion ti and the end portion tj, which are adjacent to each other in the z-axis direction. Thus, the spiral-shaped coil L that advances in the positive z-axis direction while looping in the anticlockwise direction is formed inside the multilayer body 12 by stacking the magnetic layers 16*a* to 16*p* on top of one another. The coil L is connected to the outer electrodes 14*a* and 14*b* through the drawn out portions 24*a* and 24*j*.

Figure 4A:
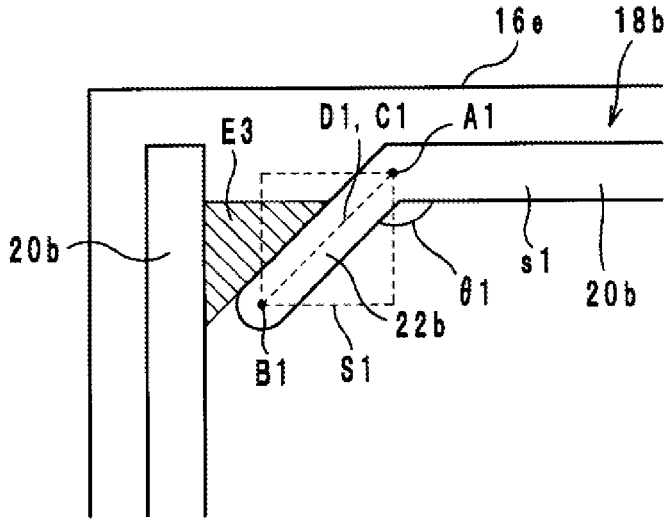
FIG. 4A is a schematic diagram of a magnetic layer of the electronic component according to an exemplary embodiment and FIG. 4B and FIG. 4C are schematic diagrams of magnetic layers of electronic components according to a first comparative example and a second comparative example corresponding to conventional electronic components.
Figure 4B:
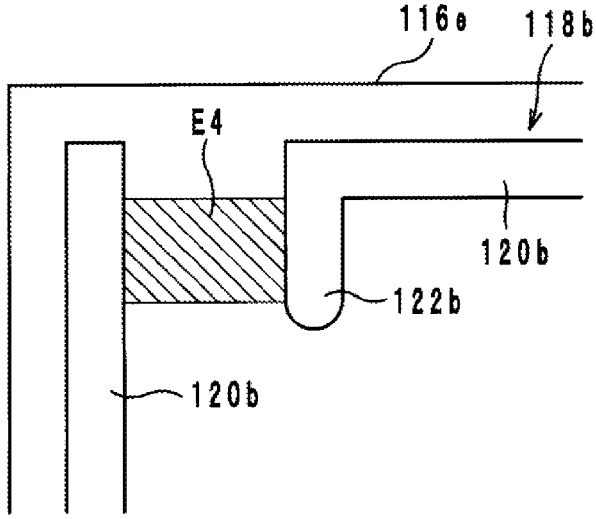
Figure 4C:
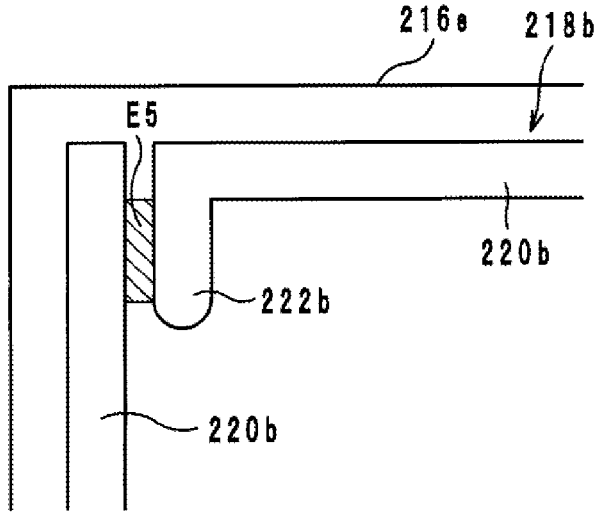

With the above-described electronic component 10, as will be described below, the inductance value can be increased while suppressing generation of short circuits inside the coil conductors 18. This will be explained below while referring to the drawings. FIG. 4A is a schematic diagram of the magnetic layer 16*e* of the electronic component 10 and FIG. 4B and FIG. 4C are schematic diagrams of magnetic layers 116*e* and 216*e* of electronic components according to first and second comparative examples (corresponding to conventional electronic components). In FIG. 4A, for ease of understanding, the structure of the coil conductor 18*b* is described in a simplified manner.

As an electronic component according to a first comparative example, when a connecting portion 122*b* extends in a direction perpendicular to a coil portion 120*b*, a region E4 enclosed by the connecting portion 122 and the coil portion 120 has a rectangular shape as illustrated in FIG. 4B. In the region E4, the lines of magnetic flux cancel each other out and therefore the existence of the region E4 is a hindrance to increasing the inductance value of the electronic component. Therefore, it is desirable to make the region E4 as small as possible.

Accordingly, in an electronic component according to a second comparative example, a connecting portion 222*b* is provided close to a coil portion 220*b* compared with the configuration shown in FIG. 4B. Thus, a region E5 is smaller than the region E4. As a result, the inductance value of the electronic component according to the second comparative example is larger than the inductance value of the electronic component according to the first comparative example.

However, in the electronic component according to the second comparative example, there is a problem in that short circuits are easily generated between the coil portion 220*b* and the connecting portion 222*b*. In more detail, a coil conductor 218*b* is formed by applying a conductive paste using screen printing. Consequently, at the time of screen printing, there is a risk of bleeding occurring at the outer edge of the coil conductor 218*b*. Then, in the case where the gap between the coil portion 220*b* and the connecting portion 222*b* is small, there is a risk of a short circuit being generated between the coil portion 220*b* and the connecting portion 222*b* due to the bleeding. The probability of such a short circuit being generated increases, the smaller the distance between adjacent portions of the coil portion 220*b* and the connecting portion 222*b* becomes. As described above, in the electronic components according to the first comparative example and the second comparative example having conventional structures, it is difficult to both increase the inductance value and prevent generation of short circuits.

In contrast, in the electronic component 10 according to this embodiment, as illustrated in FIG. 4A, the connecting portion 22*b* connects the point A1 located at one end portion of the coil portion 20*b* and the point B1 located in a direction that forms an obtuse angle θ1 with respect to the long side s1 inside a region enclosed by the coil portion 20*b* when seen from the point A1. The center line C1 of the connecting portion 22*b* linearly connects the point A1 and the point B1 to each other. Thus, a region E3 enclosed by the coil portion 20 and the connecting portion 22, as illustrated in FIG. 4A, has a triangular shape. Consequently, as illustrated in FIG. 4A and FIG. 4B, in the case where connection positions of the connecting portions 22*b* and 122*b* and the coil portions 20*b* and 120*b* are the same, the area of the region E3 is half that of the region E4. Therefore, the inductance value of the electronic component 10 is larger than the inductance value of the electronic component according to the first comparative example.

In addition, in the electronic component 10, as illustrated in FIG. 4A, only the leading end of the connecting portion 22*b* is close to the coil portion 20*b*. Therefore, the distance between adjacent portions of the connecting portion 22*b* and the coil portion 20*b* in the electronic component 10 is larger than the distance between adjacent portions of the connecting portion 222*b* and the coil portion 220*b* in the electronic component according to the second comparative example. As a result, short circuits between the connecting portion 22*b* and the coil portion 20*b* due to bleeding at the time of screen printing are less likely to occur in the electronic component 10 than in the electronic component according to the second comparative example. Thus, with the electronic component 10, it is possible to both increase the inductance value and prevent short circuits between the coil portion 20 and the connecting portion 22.

Figure 5:
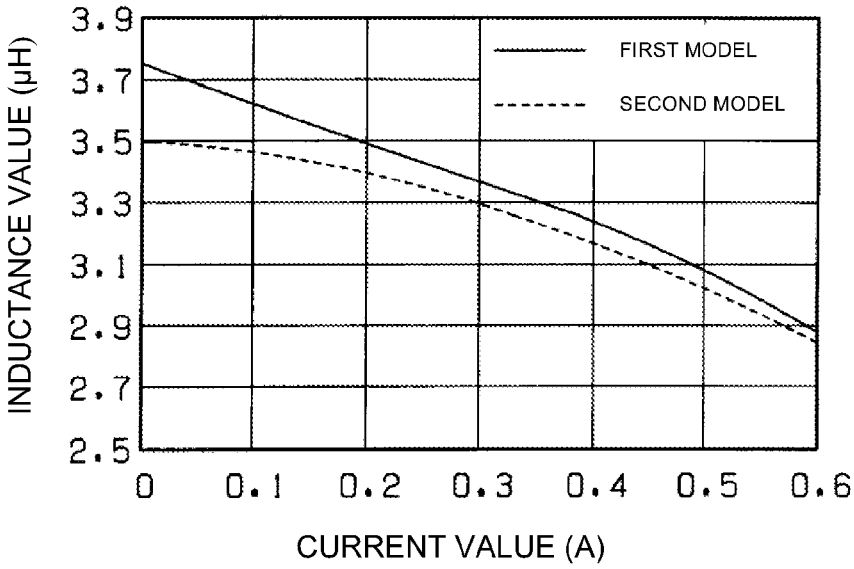
FIG. 5 is a graph illustrating the results of a computer simulation.

The inventor of the present application carried out the computer simulations described below in order to further clarify the operational advantages exhibited by the electronic component 10. In more detail, a first model having the structure illustrated in FIG. 4A (corresponding to the electronic component 10) and a second model having the structure illustrated in FIG. 4B (corresponding to the electronic component according to the first comparative example) were created and their direct current superposition characteristics were investigated. FIG. 5 is a graph illustrating the results of the computer simulation. The vertical axis represents the inductance value and the horizontal axis represents the current value.

According to FIG. 5, it is clear that the inductance value is always greater in the first model than in the second model. Therefore, it is clear that a larger inductance value can be obtained with the electronic component 10 than with the electronic component according to the first comparative example.

Figure 6:
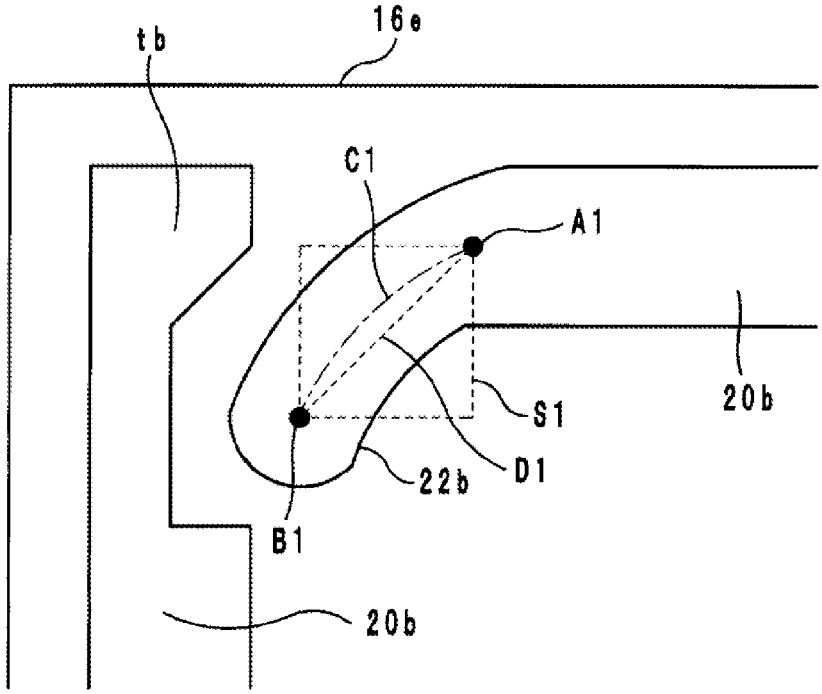
FIG. 6 is a diagram illustrating a magnetic layer of an electronic component according to an exemplary embodiment.
Figure 7:
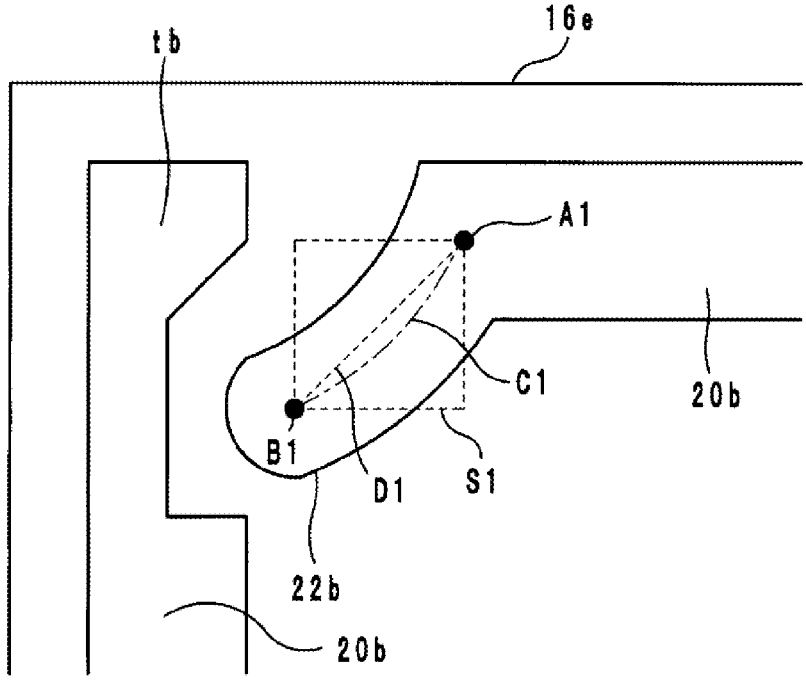
FIG. 7 is a diagram illustrating a magnetic layer of an electronic component according to an exemplary embodiment.

Electronic components according to the present disclosure are not limited to that described using the electronic component 10 and can be modified within the scope of the gist of the disclosure. Hereafter, exemplary embodiments of electronic components 10 according to modifications will be described while referring to the drawings. FIG. 6 is a diagram illustrating the magnetic layer 16*e* of an electronic component 10 according to a first exemplary modification. FIG. 7 is a diagram illustrating the magnetic layer 16*e* of an electronic component 10 according to a second exemplary modification.

In FIG. 6 and FIG. 7, the center line C1 of the connecting portion 22*b* does not linearly connect the point A1 and the point B1 but rather connects the point A1 and the point B1 in a curved manner. More specifically, in FIG. 6, the center line C1 of the connecting portion 22*b* is curved in such a manner as to bulge in a direction opposite to a direction toward the center of the coil portion 20*b*, and in FIG. 7 the center line C1 of the connecting portion 22*b* is curved in such a manner as to bulge in a direction toward the center of the coil portion 20*b*. It is also possible to both increase inductance and prevent short circuits between the coil portion 20 and the connecting portion 22 with the electronic components 10 having the structures illustrated in FIG. 6 and FIG. 7. Here, the center line C1 of the connecting portion 22*b* is located inside the rectangle S1.

In addition, in the electronic component 10 illustrated in FIG. 6, the area of the region enclosed by the coil portion and the connecting portion 22 is smaller than that in the electronic component 10 illustrated in FIG. 2. Consequently, it is possible to obtain a larger inductance value with the electronic component 10 illustrated in FIG. 6.

In contrast, in the electronic component 10 illustrated in FIG. 7, the average distance between the coil portion 20*b* and the connecting portion 22*b* is larger than that in the electronic component 10 illustrated in FIG. 2. Consequently, it is possible to effectively prevent short circuits between the coil portion 20*b* and the connecting portion 22*b* with the electronic component 10 illustrated in FIG. 7. In addition, in the electronic component 10 illustrated in FIG. 7, the area of the region enclosed by the coil portion 20 and the connecting portion 22*b* is larger than that in the electronic component 10 illustrated in FIG. 2. Consequently, it is possible to make the end portion tb larger in the electronic component 10 illustrated in FIG. 7, and the via hole conductor b1 and the end portion tb of the coil portion 20*b* can be more securely connected to each other.

A exemplary method of manufacturing an electronic component 10 will now be described with reference to FIG. 1 and FIG. 2.

Ceramic green sheets that will become the magnetic layers 16 are fabricated by using the following processes. Ferric oxide ($Fe_2O_3$), zinc oxide (ZnO), nickel oxide (NiO) and copper oxide (CuO) are weighed in a predetermined ratio, each of the materials is placed in a ball mill as raw materials, and wet mixing is performed. After being dried, the resulting mixture is ground and the resulting powder is calcined at 750° C. for one hour. After the resulting calcined powder is subjected to wet milling in a ball mill, the powder is dried and then crushed to obtain a ferromagnetic ferrite ceramic powder.

Cobalt oxide ($Co_3O_4$), a binder (vinyl acetate, a water-soluble acrylic or the like), a plasticizer, a wetting material, and a dispersing agent are added to this ferrite ceramic powder, and mixing is performed in a ball mill, and after that degassing is performed by reducing the pressure. Ceramic green sheets that will become the magnetic layers 16 are fabricated by forming the resulting ceramic slurry into sheets by using a doctor blade method and then drying the sheets.

Next, the via hole conductors b1 to b9 are formed in the respective ceramic green sheets that will become the magnetic layers 16*d* to 16*l*. Specifically, via holes are formed in the ceramic green sheets that will become the magnetic layers 16*d* to 16*l* by irradiating the sheets with a laser beam. Then, these via holes are filled with a conductive paste such as one composed of Ag, Pd, Cu, Au or an alloy of these metals by performing print coating.

Next, the coil conductors 18*a* to 18*j* are formed on the ceramic green sheets that will become the magnetic layers 16*d* to 16*m* by applying a conductive paste having a main constituent of Ag, Pd, Cu, Au or an alloy of these metals by using a screen printing method. The via hole conductors may be filled with conductive paste at the same time as the formation of the coil conductors 18*a* to 18*j*.

Next, as illustrated in FIG. 2, these ceramic green sheets are stacked on top of one another in the order of the magnetic layers 16*a* to 16*p* from the positive z-axis direction side. In more detail, first the ceramic green sheet that will become the magnetic layer 16*p* is arranged. Then, the ceramic green sheet that will become the magnetic layer 16*o* is arranged on and provisionally press bonded to the ceramic green sheet that will become the magnetic layer 16*p*. After that, the ceramic green sheets that will become the magnetic layers 16*n*, 16*m*, 16*l*, 16*k*, 16*j*, 16*i*, 16*h*, 16*g*, 16*f*, 16*e*, 16*d*, 16*c*, 16*b* and 16*a* are similarly stacked on top of one another and provisionally press bonded to one another in this order, whereby a mother multilayer body is obtained. In addition, the mother multilayer body is then subjected to permanent press bonding by, for example, using an isostatic press.

Next, yet-to-be-fired multilayer bodies 12 are obtained by cutting the mother multilayer body into pieces of predetermined dimensions by push cutting. The yet-to-be-fired multilayer bodies 12 are then subjected to a binder removal treatment and firing. The binder removal treatment is, for example, performed under conditions of 260° C. for three hours in a low oxygen atmosphere. The firing is, for example, performed under conditions of 900° C. for 2.5 hours.

Through the above processes, fired multilayer bodies 12 are obtained. The multilayer bodies 12 are then subjected to barrel processing and chamfering. After that, silver electrodes to become the outer electrodes 14*a* and 14*b* are formed on the surfaces of the multilayer bodies 12 by for example applying a conductive paste having a main constituent of silver by using an immersion method or the like and then performing baking. The silver electrodes are dried at 120° C. for fifteen minutes and the baking is performed at 700° C. for one hour. Finally, the outer electrodes 14*a* and 14*b* are formed by performing Ni plating or Si plating on the surfaces of the silver electrodes. Through the above processes, the electronic component 10 illustrated in FIG. 1 is completed.

Embodiments according to the disclosure are useful in applications for electronic components and are particularly excellent in the point that for an electronic component having a built-in coil composed of coil conductors having a length of one turn, the inductance value can be increased while suppressing the generation of short circuits inside the coil conductors.

In embodiments according to the disclosure, the inductance value in an electronic component having a built-in coil composed of coil conductors with a length of one turn can be increased while generation of short circuits inside the coil conductors is suppressed.

It should be understood that the above-described embodiments are illustrative only and that variations and modifications will be apparent to those skilled in the art without departing from the scope and spirit of the disclosure. The scope of the invention should be determined in view of the appended claims and their equivalents.

What is claimed is:

1. An electronic component comprising:

a multilayer body including a plurality of insulating layers stacked on top of one another; and a coil built into the multilayer body, said coil including:

a plurality of coil conductors each having a ring-shaped coil portion having a cut out portion in one side of one corner thereof, and a connecting portion that connects a first point located in one end portion of the coil portion at the cut out portion in the one side at the one corner of the ring-shaped coil portion and a second point located in a direction that forms an obtuse angle with a side of the coil portion extending from the first point and in a region enclosed by the coil portion when seen from the first point, the coil conductors each having a length of one turn; and a plurality of via hole conductors connecting the plurality of coil conductors to one another, wherein a center line of the connecting portion passes through a region that is inside a rectangle, said rectangle comprising sides parallel to sides of the ring-shaped coil portion, and a straight line connects the first point and the second point as a diagonal of the rectangle.

2. The electronic component according to claim 1, wherein the center line of the connecting portion connects the first point and the second point and is a straight line.

3. The electronic component according to claim 1, wherein each ring-shaped coil portion is rectangular-shaped.

4. The electronic component according to claim 2, wherein each ring-shaped coil portion is rectangular-shaped.

5. The electronic component according to claim 1, wherein the via hole conductors are composed of:

first via hole conductors that connect other end portions of the coil portions that are adjacent to each other in the stacking direction to one another, and second via hole conductors that connect the connecting portions that are adjacent to one another in the stacking direction to one another.

6. The electronic component according to claim 2, wherein the via hole conductors are composed of:

first via hole conductors that connect other end portions of the coil portions that are adjacent to each other in the stacking direction to one another, and second via hole conductors that connect the connecting portions that are adjacent to one another in the stacking direction to one another.

* * * * *